US008792800B2

(12) United States Patent
Fujiya et al.

(10) Patent No.: US 8,792,800 B2
(45) Date of Patent: Jul. 29, 2014

(54) COOLING DEVICE AND IMAGE FORMING APPARATUS INCLUDING SAME

(75) Inventors: Hiromitsu Fujiya, Kanagawa (JP); Satoshi Okano, Kanagawa (JP); Masanori Saitoh, Tokyo (JP); Tomoyasu Hirasawa, Kanagawa (JP); Keisuke Ikeda, Kanagawa (JP); Kenichi Takehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 132 days.

(21) Appl. No.: 13/427,048

(22) Filed: Mar. 22, 2012

(65) Prior Publication Data

US 2012/0263491 A1 Oct. 18, 2012

(30) Foreign Application Priority Data

Apr. 18, 2011 (JP) ..... 2011-092039

(51) Int. Cl.
*G03G 21/20* (2006.01)

(52) U.S. Cl.
USPC ..... 399/94

(58) Field of Classification Search
USPC ..... 399/94
See application file for complete search history.

(56) References Cited

U.S. PATENT DOCUMENTS

| | | | | |
|---|---|---|---|---|
| 6,615,004 | B1 * | 9/2003 | Gila et al. | 399/57 |
| 7,224,921 | B2 | 5/2007 | Iijima et al. | |
| 7,356,277 | B2 | 4/2008 | Iijima et al. | |
| 7,400,842 | B2 | 7/2008 | Takehara et al. | |
| 8,036,564 | B2 | 10/2011 | Takehara | |
| 8,068,759 | B2 | 11/2011 | Takehara et al. | |
| 2010/0008694 | A1 | 1/2010 | Okano et al. | |
| 2010/0008695 | A1 * | 1/2010 | Okano et al. | 399/94 |
| 2010/0183323 | A1 | 7/2010 | Fujiya et al. | |
| 2011/0030927 | A1 | 2/2011 | Okano et al. | |
| 2011/0052247 | A1 | 3/2011 | Saitoh et al. | |
| 2011/0052248 | A1 | 3/2011 | Nishimura et al. | |
| 2011/0052249 | A1 | 3/2011 | Iijima et al. | |
| 2011/0164896 | A1 | 7/2011 | Hirasawa et al. | |
| 2011/0170895 | A1 | 7/2011 | Fujiya et al. | |
| 2011/0188880 | A1 | 8/2011 | Suzuki et al. | |
| 2012/0061057 | A1 | 3/2012 | Okano et al. | |

FOREIGN PATENT DOCUMENTS

| | | |
|---|---|---|
| JP | 2007-24985 | 2/2007 |
| JP | 2010-20090 | 1/2010 |

OTHER PUBLICATIONS

U.S. Appl. No. 13/415,200, filed Mar. 8, 2012, Fujiya, et al.

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A cooling device using a liquid coolant, including a heat receiving part separatably contactable to a target to be cooled detachably installable in an image forming apparatus, a heat releasing part to release heat from the liquid coolant, a circulation channel through which the liquid coolant is circulated between the heat receiving part and the heat releasing part, and a pump operatively connected to the circulation channel to convey the liquid coolant through the circulation channel. The circulation channel has a flexible part and a metal part continuous with the flexible part.

18 Claims, 4 Drawing Sheets

COOLING DEVICE AND IMAGE FORMING APPARATUS INCLUDING SAME

CROSS-REFERENCE TO RELATED APPLICATION

The present patent application is based on and claims priority pursuant to 35 U.S.C. §119 from Japanese Patent Application No. 2011-092039, filed on Apr. 18, 2011 in the Japan Patent Office, which is incorporated by reference herein in its entirety.

BACKGROUND OF THE INVENTION

1. Field of the Invention

Exemplary aspects of the present invention generally relate to a liquid cooling type cooling device (liquid cooling device) using a liquid coolant and an image forming apparatus including the liquid cooling device.

2. Description of the Related Art

Related-art image forming apparatuses, such as copiers, printers, facsimile machines, and multifunction devices having two or more of copying, printing, and facsimile capabilities, typically form an image of characters, symbols, or the like on a recording medium (e.g., a sheet of paper, an OHP sheet, etc.) according to image data using a variety of methods. Of these, an electrophotographic method that achieves higher definition images at higher speed is widely employed.

In the electrophotographic method, for example, an optical device reads image data of a document, a charger charges a surface of an image carrier (e.g., a photoconductor); a writing device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

During image formation, driving of many devices provided within the image forming apparatus generate heat, and the heat thus generated increases the temperature within the image forming apparatus. For example, in the optical device, a scanner lamp that scans the document with light and a scanner motor that drives the scanner lamp both generate heat. In the writing device, a motor that rotates a polygon mirror at high speed generates heat. In the developing device, frictional heat is generated when toner is agitated to be charged, and in the fixing device, a heater that fixes the toner image onto the recording medium generates heat. In addition, in the case of duplex image formation, the recording medium heated by the fixing device passes through a conveyance path for duplex image formation, thereby increasing temperature around the conveyance path.

The heat thus generated causes various problems. For example, toner particles stored in the developing device can be melted together and coagulate, causing irregular images or a breakdown of the developing device when the melted toner is solidified, thereby locking moving parts within the developing device. The temperature increase within the image forming apparatus may further cause deterioration of oil applied to bearings and so forth, shorter mechanical life of a motor, malfunctions or breakdown of an IC on an electric substrate, and deformation of resin members with lower thermal resistance. To prevent the problems caused by the temperature increase within the image forming apparatuses, image forming apparatuses are typically provided with an air cooling type cooling device (air cooling device) that cools the interior of the apparatuses using cooling fans, ducts, and so forth.

However, the number of heat generators provided within the image forming apparatuses continues to increase along with faster processing speed. In addition, in order to meet demand for more compact image forming apparatuses, components tend to be densely packed within the apparatuses. Consequently, it is difficult to provide an optimal airflow system within the image forming apparatuses, thereby causing the heat to remain trapped in the interior of the image forming apparatuses. Further, toner having a lower melting point that reduces power consumption during fixing of the toner image onto the recording medium has been developed in order to meet increasing demand for energy saving. Therefore, a temperature increase within the image forming apparatuses needs to be more securely prevented particularly in a case of using such toner. For these reasons, it is difficult for the air cooling device to reliably cool the image forming apparatuses.

There is known a liquid cooling device that has a greater cooling capacity than that of the air cooling device. The liquid cooling device typically includes a heat receiving part disposed at a position where the temperature tends to increase in the image forming apparatus, a heat releasing part that releases heat from a liquid coolant, a circulation channel through which the liquid coolant circulates between the heat receiving part and the heat releasing part, a pump that causes the liquid coolant to flow through the circulation channel, and so forth. The liquid coolant is circulated between the heat receiving part and the heat releasing part by the pump so that the heat absorbed by the liquid coolant via the heat receiving part is released from the liquid coolant at the heat releasing part. Unlike the air cooling device, the liquid cooling device transports the heat using a liquid coolant which has a larger heat capacity than air. Therefore, the liquid cooling device has better heat receiving capability and can effectively cool the target.

However, at the same time, leakage of the liquid coolant within the image forming apparatus may occur. If the liquid coolant leaks from pipes or joints that couple the pipes of the circulation channel together and adheres to a power source or image forming units, not only irregular images but also a breakdown of the image forming apparatus may occur.

To solve the above-described problems, a related-art liquid cooling device 90 illustrated in FIG. 1 includes pipes 41 and 42 provided at input and output openings of a heat receiving part 310, respectively, a joint 45 that couples the pipe 41 to a tube 51, a joint 46 that couples the pipe 42 to a tube 52, and a pair of shielding members 80. The joints 45 and 46 are disposed within a space Z formed between the shielding members 80 and are isolated from an image forming unit including a developing device 400. Accordingly, in the event of leakage of the liquid coolant from the joints 45 and 46, the image forming units and so forth are prevented from getting wet with the liquid coolant.

The developing device, the fixing device, and so forth are often detachably installable in the image forming apparatus so that only the developing device or the fixing device need be replaced with a new device upon breakdown of the device or at the end of the service life of the device. In a case in which the developing device, for example, is detachably installable in the image forming apparatus, installation and detachment of the developing device to and from the image forming apparatus are facilitated by moving the heat receiving part to be separated from the developing device although the heat receiving part needs to contact the developing device so as to cool the developing device.

However, if the developing device 400 shown in FIG. 1 is detachably installable in the image forming apparatus, it is difficult to separate the heat receiving part 310 from the developing device 400 upon installation and detachment of the developing device 400. Specifically, the pipes 41 and 42 provided to the input and output openings of the heat receiving part 310, respectively, and the shielding members 80 prevent movement of the heat receiving part 310, thereby preventing separation of the heat receiving part 310 from the developing device 400. Thus, the related-art liquid cooling device is not suitable for cooling a developing device or other target that is detachably installable in the image forming apparatus.

BRIEF SUMMARY OF THE INVENTION

In view of the foregoing, illustrative embodiments of the present invention provide a cooling device that cools a target detachably installable in an image forming apparatus and the image forming apparatus including the cooling device.

In one illustrative embodiment, a cooling device using a liquid coolant includes a heat receiving part separately contactable to a target to be cooled detachably installable in an image forming apparatus, a heat releasing part to release heat from the liquid coolant, a circulation channel through which the liquid coolant is circulated between the heat receiving part and the heat releasing part, and a pump operatively connected to the circulation channel to convey the liquid coolant through the circulation channel. The circulation channel has a flexible part and a metal part continuous with the flexible part.

In another illustrative embodiment, a cooling device using a liquid coolant includes a heat receiving part separately contactable to a target to be cooled detachably installable in an image forming apparatus, a heat releasing part to release heat from the liquid coolant, a circulation channel through which the liquid coolant is circulated between the heat receiving part and the heat releasing part, and a pump operatively connected to the circulation channel to convey the liquid coolant through the circulation channel. The circulation channel includes a heat receiving pipe passing through the heat receiving part, a liquid flow pipe through which the liquid coolant flows to and from the heat receiving part, and a connection pipe to connect input and output ends of the heat receiving pipe, both of which protrude from the heat receiving part, to respective ends of the liquid flow pipe. The connection pipe is formed of a flexible material, and the heat receiving pipe and the liquid flow pipe are formed of metal.

In yet another illustrative embodiment, an image forming apparatus includes a target to be cooled detachably installable in the image forming apparatus and the cooling device described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
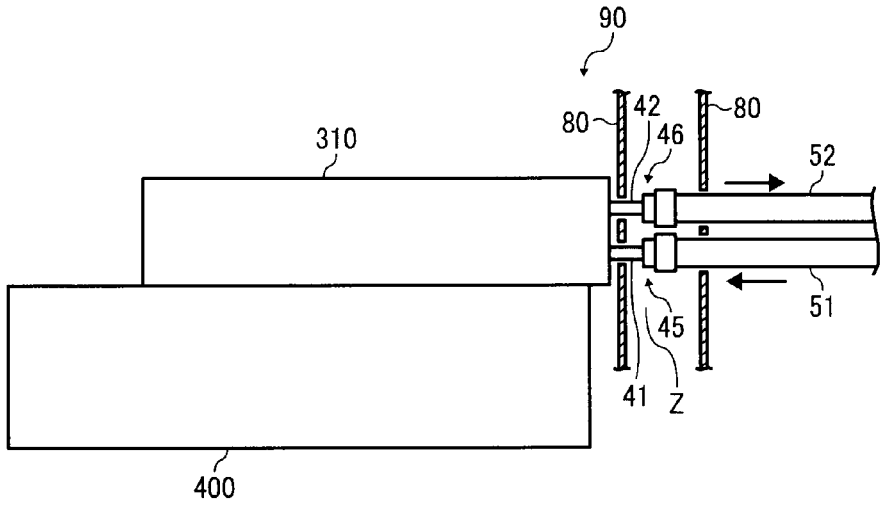
FIG. 1 RELATED ART
FIG. 1 is a schematic view illustrating an example of a configuration of a related-art cooling device.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of a full-color image forming apparatus 100 according to illustrative embodiments are described in detail below.

Figure 2:
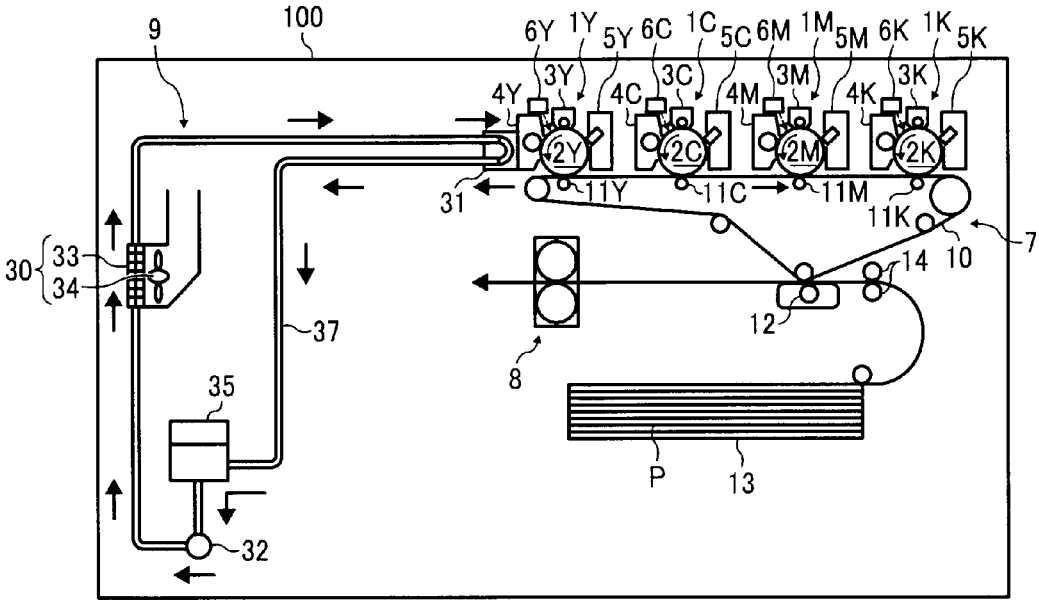
FIG. 2 is a schematic vertical cross-sectional view illustrating an example of a configuration of a full-color image forming apparatus including a cooling device according to illustrative embodiments.

FIG. 2 is a schematic vertical cross-sectional view illustrating an example of a configuration of the image forming apparatus 100 including a cooling device 9 according to illustrative embodiments.

The image forming apparatus 100 includes four image forming units 1Y, 1C, 1M, and 1K (hereinafter collectively referred to as image forming units 1), each forming an image of a specified color, that is, yellow (Y), cyan (C), magenta (M), or black (K). It is to be noted that, each of the four image forming units 1 has the same basic configuration, differing only in the color of toner used.

The image forming units 1 respectively include latent image carriers, which, in illustrative embodiments, are photoconductors 2Y, 2C, 2M, and 2K (hereinafter collectively referred to as photoconductors 2), chargers 3Y, 3C, 3M, and 3K (hereinafter collectively referred to as chargers 3) that respectively charge surfaces of the photoconductors 2, writing devices 6Y, 6C, 6M, and 6K (hereinafter collectively referred to as writing devices 6) that respectively form electrostatic latent images on the charged surfaces of the photoconductors 2, developing devices 4Y, 4C, 4M, and 4K (hereinafter collectively referred to as developing devices 4) that respectively form toner images on the surfaces of the photoconductors 2, and cleaning devices 5Y, 5C, 5M, and 5K (hereinafter collectively referred to as cleaning devices 5) that respectively clean the surfaces of the photoconductors 2.

The image forming apparatus 100 further includes a transfer device 7 disposed below the image forming units 1. The transfer device 7 includes an endless intermediate transfer belt 10 wound around multiple rollers, one of which is a drive roller. Rotation of the drive roller rotates the intermediate transfer belt 10 in a clockwise direction in FIG. 2.

Four primary transfer rollers 11Y, 11C, 11M, and 11K (hereinafter collectively referred to as primary transfer rollers 11) are disposed opposite the photoconductors 2, respectively, with the intermediate transfer belt 10 interposed therebetween. The primary transfer rollers 11 press an inner circumferential surface of the intermediate transfer belt 10 to form primary transfer nips between the intermediate transfer belt 10 and the photoconductors 2, respectively. Each of the primary transfer rollers 11 is connected to a power source, not shown, so that a predetermined amount of direct current (DC) and/or alternating current (AC) is supplied to each of the primary transfer rollers 11.

A secondary transfer roller 12 is disposed opposite one of the multiple rollers around which the intermediate transfer belt 10 is wound. The secondary transfer roller 12 presses an outer circumferential surface of the intermediate transfer belt 10 to form a secondary transfer nip between the intermediate transfer belt 10 and the secondary transfer roller 12. In a manner similar to the primary transfer rollers 11, the secondary transfer roller 12 is connected to a power source, not shown, so that a predetermined amount of direct current (DC) and/or alternating current (AC) is supplied to the secondary transfer roller 12.

The image forming apparatus 100 further includes a sheet feeder 13 that supplies a recording medium P such as a sheet of paper and an OHP sheet to the secondary transfer nip, a pair of registration rollers 14 that adjusts a timing to convey the recording medium P fed from the sheet feeder 13 to the secondary transfer nip, and a fixing device 8 that fixes a toner image onto the recording medium P.

A description is now given of operations of the image forming apparatus 100.

At the start of image formation, the photoconductors 2 are rotatively driven so that the chargers 3 evenly charge the surfaces of the photoconductors 2 to a predetermined polarity, respectively. Next, the writing devices 6 direct laser light onto the charged surfaces of the photoconductors 2, respectively, based on image data of a document read by a reading device, not shown, so that electrostatic latent images are formed on the surfaces of the photoconductors 2, respectively. At this time, each of the writing devices 6 writes image data of a single color, which is obtained by separating a full-color image to be formed into color data of yellow (Y), cyan (C), magenta (M), and black (K), onto the surface of each of the photoconductors 2, respectively. The developing devices 4 supply toner of the specified color to the electrostatic latent images formed on the surfaces of the photoconductors 2, respectively, so that toner images of the respective colors are formed on the surfaces of the photoconductors 2.

Meanwhile, the drive roller, which is one of the multiple rollers around which the intermediate transfer belt 10 is wound, is rotatively driven to rotate the intermediate transfer belt 10. A constant voltage having a polarity opposite a charging polarity of toner or a voltage subjected to constant voltage control is supplied to each of the primary transfer rollers 11 so that a transfer electrical field is formed at each of the primary transfer nips. The toner images formed on the surfaces of the photoconductors 2 are sequentially transferred onto the intermediate transfer belt 10 at the primary transfer nips by the transfer electrical fields and are superimposed one atop the other to form a single full-color toner image on the intermediate transfer belt 10. Untransferred toner remaining on the surfaces of the photoconductors 2 is removed by the cleaning devices 5, respectively.

Also at the start of image formation, the recording medium P is fed from the sheet feeder 13. Conveyance of the recording medium P fed from the sheet feeder 13 is temporarily stopped by the pair of registration rollers 14. Thereafter, the pair of registration rollers 14 conveys the recording medium P to the secondary transfer nip formed between the secondary transfer roller 12 and the intermediate transfer belt 10 in synchronization with the full-color toner image formed on the intermediate transfer belt 10. A transfer voltage having a polarity opposite the charging polarity of toner in the full-color toner image formed on the intermediate transfer belt 10 is supplied to the secondary transfer roller 12 so that a transfer electrical field is formed at the secondary transfer nip. Accordingly, the full-color toner image formed on the intermediate transfer belt 10 is secondarily transferred onto the recording medium P by the transfer electrical field formed at the secondary transfer nip. The recording medium P having the full-color toner image thereon is then conveyed to the fixing device 8 so that the full-color toner image is fixed onto the recording medium P. Thereafter, the recording medium P having the fixed image thereon is discharged to a discharge tray, not shown.

Although full-color image formation is described in the above example, alternatively, a monochrome image may be formed using only one of the image forming units 1 or a two- or three-colored image may be formed using two or three of the image forming units 1 in the image forming apparatus 100.

A description is now given of a configuration of the cooling device 9 provided to the image forming apparatus 100 according to illustrative embodiments.

The cooling device 9 that cools a portion of the image forming apparatus 100, the temperature of which is increased, is disposed within the image forming apparatus 100. In illustrative embodiments, the cooling device 9 employs a liquid-cooling system using a liquid coolant. The cooling device 9 includes heat receiving parts 31, a heat releasing part 30, a pump 32, a tank 35, and a pipe assembly 37 that connects the heat receiving parts 31, the heat releasing part 30, the pump 32, and the tank 35 to construct a circulation channel through which the liquid coolant circulates. The heat releasing part 30 includes a radiator 33 and a fan 34 that brows air into the radiator 33. An example of the liquid coolant includes, but is not limited to, antifreeze containing a rust inhibitor.

Here, each of the developing devices 4 respectively included in the image forming units 1 is a target to be cooled by the cooling device 9. Accordingly, the heat receiving parts 31 included in the cooling device 9 are disposed to contact the developing devices 4, respectively. It is to be noted that only the heat receiving part 31 provided for the image forming units 1Y is shown in FIG. 2, and the heat receiving parts 31 provided for the image forming units 1C, 1M, and 1K, respectively, are omitted for ease of illustration.

Operations of the cooling device 9 are described in detail below.

The liquid coolant cooled by the heat releasing part 30 is conveyed to the heat receiving parts 31 by the pump 32. Heat is transmitted from the developing devices 4 to the liquid coolant via the respective heat receiving parts 31 so that the developing devices 4 are cooled by the liquid coolant. The liquid coolant, the temperature of which is increased at the heat receiving parts 31 due to the heat transmitted from the developing devices 4, is conveyed back to the heat releasing part 30 via the tank 35 and the pump 32 to be cooled by the heat releasing part 30. Thus, a cycle of heat absorption at the heat receiving parts 31 and heat radiation at the heat releasing part 30 is repeatedly performed by circulation of the liquid coolant between the heat receiving parts 31 and the heat releasing part 30. As a result, a temperature increase in the developing devices 4 is prevented, thereby avoiding formation of irregular images. The tank 35 functions as a reservoir that temporarily retains the liquid coolant conveyed from the radiator 33. Accordingly, a large pressure fluctuation within the circulation channel is prevented.

Figure 3:
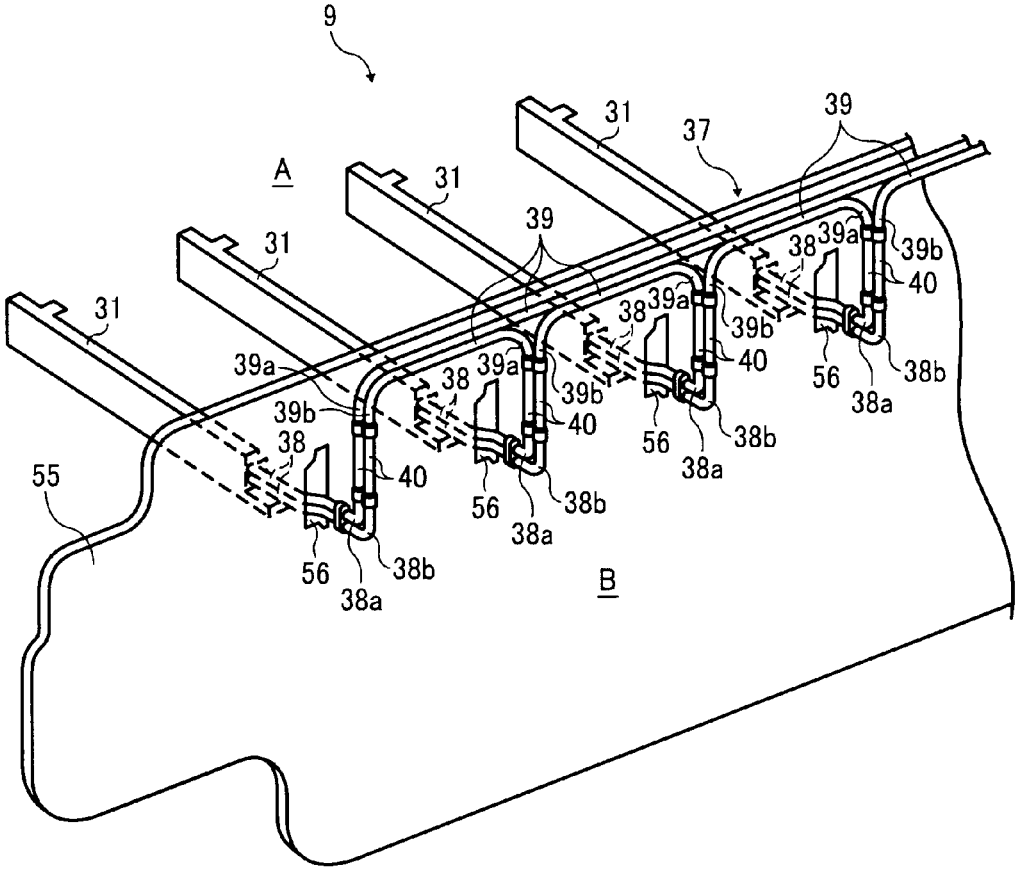
FIG. 3 is a perspective view illustrating an example of a configuration of a cooling device according to a first illustrative embodiment.

A description is now given of an example of a configuration of the cooling device 9 according to a first illustrative embodiment. FIG. 3 is a perspective view illustrating an example of a configuration of the cooling device 9 according to the first illustrative embodiment.

As illustrated in FIG. 3, the four heat receiving parts 31 are disposed corresponding to the developing devices 4 included in the image forming units 1, respectively. The heat receiving parts 31 are connected to one another by the pipe assembly 37 that constructs the circulation channel. The pipe assembly 37 includes heat receiving pipes 38, liquid flow pipes 39, and connection pipes 40.

The heat receiving pipes 38 are provided to pass through the heat receiving parts 31, respectively. The heat received by the heat receiving parts 31 from the developing devices 4 is transmitted to the liquid coolant via the heat receiving pipes 38 while the liquid coolant passes through the heat receiving pipes 38. In the present illustrative embodiment, each of the heat receiving pipes 38 is a copper pipe having good thermal conductivity.

The liquid coolant flows to and from the heat receiving parts 31 through the liquid flow pipes 39. Specifically, the liquid flow pipes 39 connect the heat receiving parts 31 to one another and the heat receiving parts 31 to the heat releasing part 30, the tank 35, or the like. In the present illustrative embodiment, each of the liquid flow pipes 39 is an aluminum pipe.

The connection pipes 40 connect inflow ends 38*a* of the heat receiving pipes 38 protruding from the heat receiving parts 31 to inflow ends 39*a* of the liquid flow pipes 39, and outflow ends 38*b* of the heat receiving pipes 38 protruding from the heat receiving parts 31 to outflow ends 39*b* of the liquid flow pipes 39, respectively. The connection pipes 40 are formed of a flexible material. In the present illustrative embodiment, an elastic material such as rubber is used for the connection pipes 40.

A space A where the heat receiving parts 31 are disposed and a space B where the liquid flow pipes 39 and the connection pipes 40 are disposed are isolated from each other by a partition member, which, in the present illustrative embodiment, is a metal lateral plate 55. The lateral plate 55 has four openings 56, into which parts of the heat receiving pipes 38 protruding from the heat receiving parts 31 are inserted, respectively.

In the present illustrative embodiment, the developing devices 4 are detachably installable in the image forming apparatus 100. Each of the developing devices 4 may be independently installed and detached to and from the image forming apparatus 100, or may be installed and detached to and from the image forming apparatus 100 together with each of the photoconductors 2 and so forth. In order to facilitate installation and detachment of the developing devices 4 to and from the image forming apparatus 100, each of the heat receiving parts 31 are separately contactable to the corresponding developing device 4 by a contact/separation mechanism, not shown.

As described above, the connection pipes 40 of the pipe assembly 37 are formed of a flexible material in the present illustrative embodiment. Accordingly, the connection pipes 40 are easily deformed to move the heat receiving parts 31 while the heat receiving parts 31 are still connected to the pipe assembly 37. As a result, the heat receiving parts 31 can be easily separated from the corresponding developing devices 4, respectively, upon installation and detachment of the developing devices 4 to and from the image forming apparatus 100, thereby facilitating installation and detachment of the developing devices 4.

Upon contact and separation of the heat receiving parts 31 to and from the developing devices 4, the heat receiving pipes 38 are moved together with the heat receiving parts 31. Each of the openings 56 is dimensioned such that movement of the heat receiving pipes 38 is not prevented by edges of the openings 56.

In the pipe assembly 37, all the parts except the connection pipes 40, that is, the heat receiving pipes 38 and the liquid flow pipes 39, are constructed of metal as described previously. Thus, most of the pipe assembly 37 has good durability, thereby preventing leakage of the liquid coolant. It is to be noted that, although the heat receiving pipes 38 and the liquid flow pipes 39 may be alternatively formed of metals other than copper and aluminum, it is preferable that the heat receiving pipes 38 be formed of a material having good thermal conductivity such as copper and aluminum.

In the event of leakage of the liquid coolant from the connection pipes 40, the connection pipes 40 are disposed in the space B isolated, by the lateral plate 55, from the space A in which the image forming units 1 respectively including the developing devices 4 and so forth are disposed. Accordingly, any liquid coolant leaking from the connection pipes 40 is prevented from flowing toward the image forming units 1. Although the shorter connection pipes 40 can reduce damage caused by leakage of the liquid coolant, it is preferable that a length of each of the connection pipes 40 be determined based on durability of materials that form the connection pipes 40, a distance or direction of movement of the heat receiving parts 31, and so forth.

Figure 4:
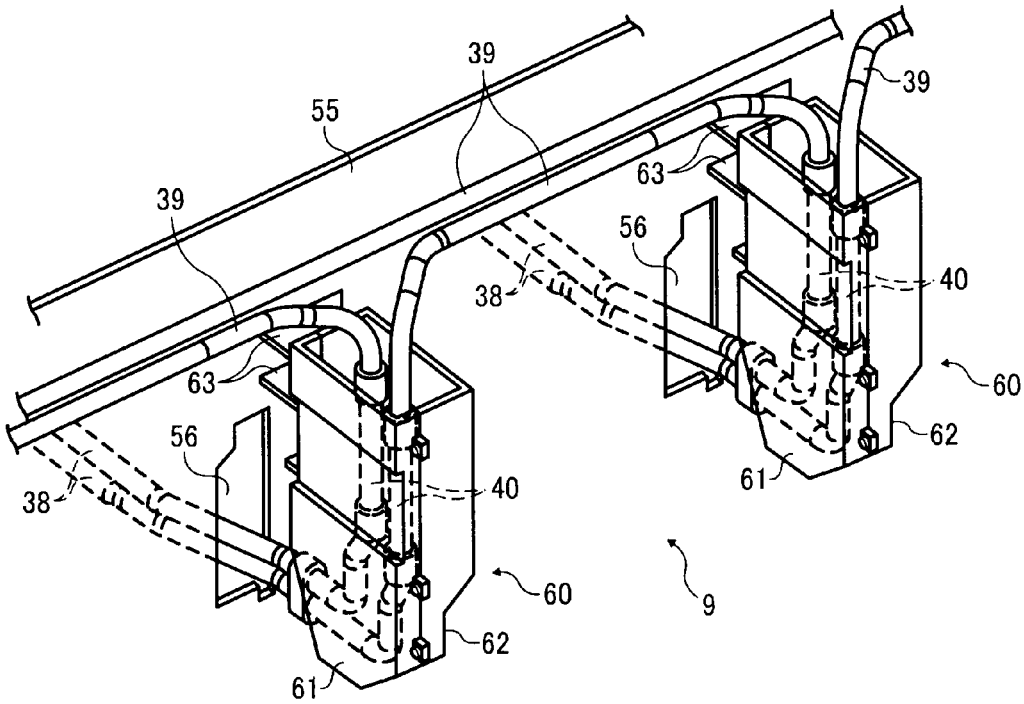
FIG. 4 is a perspective view illustrating an example of a configuration of a cooling device according to a second illustrative embodiment.

FIG. 4 is a perspective view illustrating an example of a configuration of the cooling device 9 according to a second illustrative embodiment.

In the second illustrative embodiment, shielding assemblies 60 are disposed around the connection pipes 40 as illustrated in FIG. 4. The rest of the configuration according to the second illustrative embodiment is the same as that of the first illustrative embodiment. Each of the shielding assemblies 60 is constructed of two U-shaped members 61 and 62 which face and engage with each other to form a single rectangular tubular shielding assembly 60. Each of the shielding assemblies 60 has mounts 63 to be fixed to the lateral plate 55 with fastening members such as screws. In the example illustrated in FIG. 4, upper and lower ends of each of the shielding assemblies 60 are positioned 10 mm above and below upper and lower ends of each of the connection pipes 40, respectively.

Thus, the shielding assemblies 60 are disposed surrounding the connection pipes 40 in the second illustrative embodiment. Accordingly, even in a case in which the liquid coolant leaks from the connection pipes 40, scattering of the liquid coolant can be prevented. As a result, the liquid coolant is more securely prevented from flowing toward the image forming units 1. In view of preventing scattering of the liquid coolant, it is preferable that openings respectively provided to the upper and lower ends of each of the shielding assemblies 60 be smaller. However, the opening provided to the lower end of each of the shielding assemblies 60 needs to be large enough to allow free movement of the heat receiving pipes 38 upon contact and separation of the heat receiving parts 31 to and from the developing devices 4.

Figure 5:
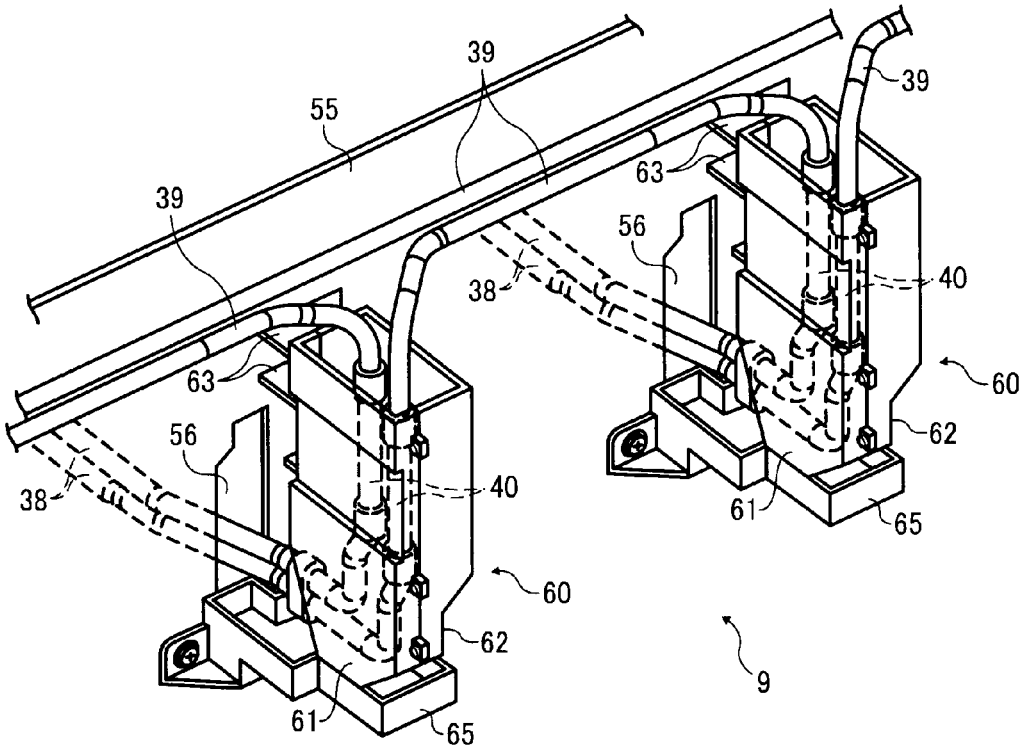
FIG. 5 is a perspective view illustrating an example of a configuration of a cooling device according to a third illustrative embodiment.

FIG. 5 is a perspective view illustrating an example of a configuration of the cooling device 9 according to a third illustrative embodiment.

In addition to the configuration according to the second illustrative embodiment, the cooling device 9 according to the third illustrative embodiment further includes spill trays 65 provided below the shielding assemblies 60, respectively, to receive the liquid coolant. The rest of the configuration according to the third illustrative embodiment is the same as that of the second illustrative embodiment. Each of the spill trays 65 is fixed to the lateral plate 55 with fastening members such as screws.

Thus, the spill trays 65 are disposed below the shielding assemblies 60, respectively, in the third illustrative embodiment. Accordingly, even in a case in which the liquid coolant leaks from the connection pipes 40, the liquid coolant dropping along the shielding assemblies 60 can be received and retained by the spill trays 65. As a result, the liquid coolant is more securely prevented from flowing toward the image forming units 1. In addition, leakage of the liquid coolant can be easily detected by simply confirming presence of the liquid coolant in the spill trays 65. In particular, when the multiple connections pipes 40 are used as in the case of illustrative embodiments, the connection pipe(s) 40 from which the liquid coolant leaks can be easily specified by confirming presence of the liquid coolant in the spill trays 65.

Figure 6:
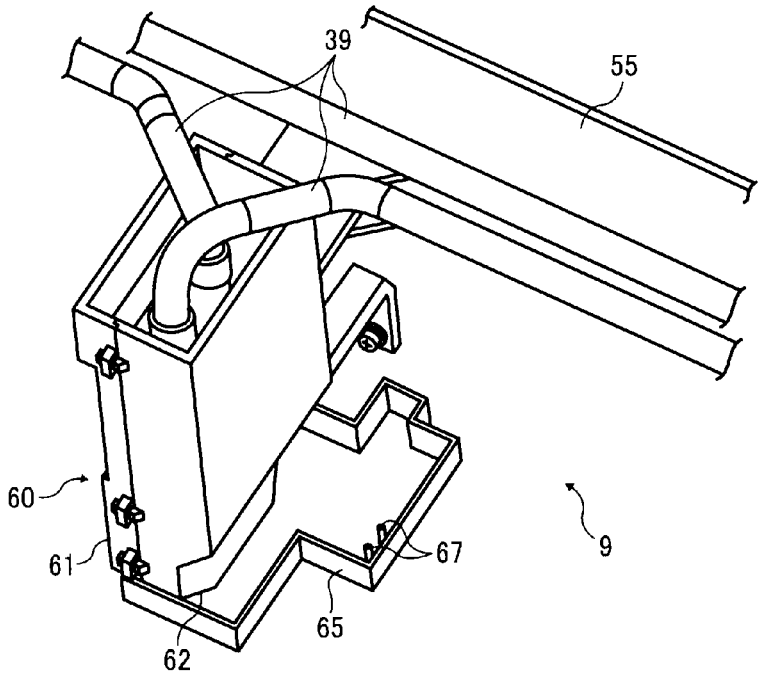
FIG. 6 is a perspective view illustrating an example of a configuration of a cooling device according to a fourth illustrative embodiment.

FIG. 6 is a perspective view illustrating an example of a configuration of the cooling device 9 according to a fourth illustrative embodiment.

In addition to the configuration according to the third illustrative embodiment, the cooling device 9 according to the fourth illustrative embodiment further includes a liquid coolant detector, which, in the present illustrative embodiment, is two stainless steel electrode pins 67, that detects presence of the liquid coolant in the spill trays 65. One of the two electrode pins 67 is supplied with a voltage so that an electrical current flows between the two electrode pins 67 when the spill trays 65 retain the liquid coolant, thereby detecting leakage of the liquid coolant. When leakage of the liquid coolant is detected by the electrode pins 67, a notification unit, not shown, notifies a user of the leakage of the liquid coolant using sound, light, display on an operation panel, or the like.

As a result, the user can, for example, stop driving of the pump 32 immediately after occurrence of leakage of the liquid coolant, thereby containing any damage caused by leakage of the liquid coolant at an earlier stage. Because leakage of the liquid coolant can be detected and stopped earlier, each of the spill trays 65 can be downsized, thereby achieving space-saving configuration. It is to be noted that the voltage supplied to the one of the two electrode pins 67 is low enough so that it does not affect properties of the liquid coolant, in order to, for example, prevent occurrence of electrolysis. In addition, and for the same reason, it is preferable that the voltage be supplied to the one of the two electrode pins 67 intermittently rather than constantly.

Figure 7:
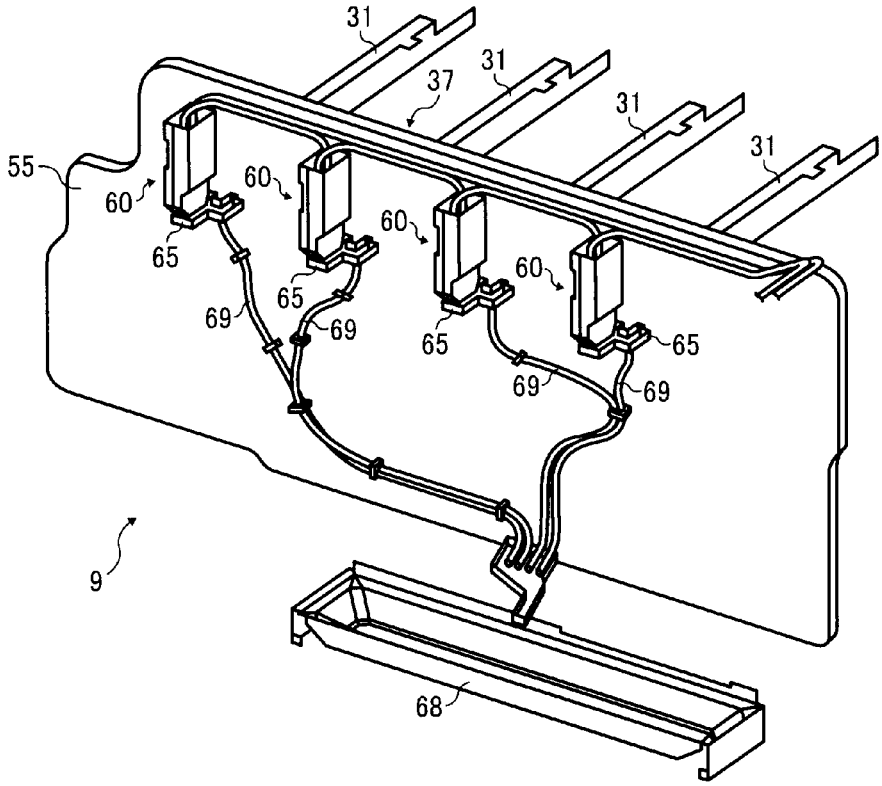
FIG. 7 is a perspective view illustrating an example of a configuration of a cooling device according to a fifth illustrative embodiment.

FIG. 7 is a perspective view illustrating an example of a configuration of the cooling device 9 according to a fifth illustrative embodiment.

In addition to the configuration according to the third or fourth illustrative embodiment in which the spill trays 65 are further provided, the cooling device 9 according to the fifth illustrative embodiment further includes a collection container 68 to which the liquid coolant retained by the spill trays 65 is collected to one place. A tube 69 is connected to each of the spill trays 65, through which the liquid coolant flows to the collection container 68. The rest of the configuration according to the fifth illustrative embodiment is the same as that of the third or fourth illustrative embodiment.

Because the tubes 69 are provided only for the case of leakage of the liquid coolant and the liquid coolant normally does not flows through the tubes 69, only temporary durability against the liquid coolant is required for the tubes 69. Therefore, inexpensive members such as resin tubes may be used for the tubes 69. Although the collection container 68 shown in FIG. 7 is formed by sheet metal drawing, alternatively, a mold may be used for forming the collection container 68. The collection container 68 is dimensioned as appropriate based on an estimated amount of the liquid coolant leaking from the connection pipes 40.

The liquid coolant retained by the spill trays 65 is collected to the collection container 68 in the fifth illustrative embodiment, thus facilitating disposal. In addition, because the liquid coolant does not need to be stored in the spill trays 65, each of the spill trays 65 can be downsized, thereby achieving space-saving configuration. The collection container 68 may be detachably installable in the cooling device 9. In such a case, the liquid coolant can be further easily disposed of by simply detaching the collection container 68 from the cooling device 9. Further, the placement of the collection container 68 is not limited to the example illustrated in FIG. 7, and the collection container 68 may be disposed at any position that provides easy access and handling.

It is to be noted that a liquid amount detector that detects an amount of liquid coolant retained by the tank 35 may be provided. In such a case, a decrease in the amount of liquid coolant retained in the tank 35 is detected by the liquid amount detector when leakage of the liquid coolant occurs to notify the user of the leakage. In the example illustrated in FIG. 7, when an amount of liquid coolant leaking from the connection pipes 40 is too small, such liquid coolant may be evaporated on the way to be collected to the collection container 68 and is not retained by the collection container 68. Consequently, the leakage of the liquid coolant may not be detected even when a liquid coolant detector such as the electrode pins 67 are provided to the collection container 68. By contrast, even a very small amount of liquid coolant leaking from the connection pipes 40 can be detected by the liquid amount detector provided to the tank 35.

Thus, according to the foregoing illustrative embodiments, a part of the circulation channel disposed closer to the heat receiving parts 31, that is, the collection pipes 40, are formed of a flexible material in the cooling device 9. Accordingly, the connection pipes 40 are deformed so that the heat receiving parts 31 can be easily separated from the developing devices 4, respectively, upon installation and detachment of the developing devices 4 to and from the image forming apparatus 100. As a result, installation and detachment of the developing devices 4 to and from the image forming apparatus 100 are facilitated. In addition, the rest of the circulation channel, that is, the heat receiving pipes 38 and the liquid flow pipes 39, are constructed of metal members having good durability, thereby preventing leakage of the liquid coolant. Thus, the foregoing illustrative embodiments can provide the cooling device 9 that reliably cools the target detachably installable in the image forming apparatus 100.

It is to be noted that, the target to be cooled by the heat receiving parts 31 is not limited to the developing devices 4. For example, in a case in which the photoconductors 2, the fixing device 8, or the like are/is detachably installable in the image forming apparatus 100, the heat receiving parts 31 may be separately contactable to the photoconductors 2, the fixing device 8, or the like.

Although being provided to the tandem-type image forming apparatus 100 employing an electrophotographic method in which the four photoconductors 2 are arranged side by side in a horizontal direction in the foregoing illustrative embodiments, alternatively, the cooling device 9 is also applicable to a monochrome image forming apparatus which forms a monochrome image, a full-color image forming apparatus using toner of five or more different colors, a copier, a printer, a facsimile machine, or a multifunction device having two or more of copying, printing, and facsimile capabilities.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cooling device using a liquid coolant, comprising:

a heat receiving part separately contactable to a target to be cooled, the target being detachably installable in an image forming apparatus;

a heat releasing part to release heat from the liquid coolant;

a circulation channel through which the liquid coolant is circulated between the heat receiving part and the heat releasing part, the circulation channel including a flexible part and a metal part continuous with the flexible part;

a shielding member surrounding an entirety of a longitudinal extension of the flexible part of the circulation channel; and a pump operatively connected to the circulation channel to convey the liquid coolant through the circulation channel.

2. A cooling device using a liquid coolant, comprising:

a heat receiving part separately contactable to a target to be cooled, the target being detachably installable in an image forming apparatus;

a heat releasing part to release heat from the liquid coolant;

a circulation channel through which the liquid coolant is circulated between the heat receiving part and the heat releasing part, the circulation channel including:

a heat receiving pipe passing through the heat receiving part, a liquid flow pipe through which the liquid coolant flows to and from the heat receiving part, and a connection pipe to connect input and output ends of the heat receiving pipe, both of which protrude from the heat receiving part, to respective ends of the liquid flow pipe; and a pump operatively connected to the circulation channel to convey the liquid coolant through the circulation channel, wherein the connection pipe is formed of a flexible material, and the heat receiving pipe and the liquid flow pipe are formed of metal, and wherein a shielding member surrounds an entirety of a longitudinal extension of the flexible connection pipe of the circulation channel.

3. The cooling device according to claim 1, further comprising a partition member interposed between the flexible part of the circulation channel and the target to be cooled.

4. The cooling device according to claim 3, wherein the partition member has an opening into which a portion of the circulation channel is inserted, dimensioned to allow displacement of the portion of the circulation channel inserted into the opening upon contact and separation of the heat receiving part to and from the target to be cooled.

5. The cooling device according to claim 1, further comprising a spill tray disposed below the shielding member.

6. The cooling device according to claim 5, further comprising a liquid coolant detector disposed in the spill tray to detect presence of the liquid coolant in the spill tray.

7. The cooling device according to claim 5, further comprising:

multiple spill trays;

a collection container; and a conveyance channel connecting the multiple spill trays and the collection container, through which the liquid coolant retained by the multiple spill trays is drained into the collection container.

8. The cooling device according to claim 7, wherein the collection container is detachably installable in the cooling device.

9. The cooling device according to claim 1, further comprising a reservoir to temporarily retain the liquid coolant circulating through the circulation channel.

10. The cooling device according to claim 1, wherein the metal part is formed of copper or aluminum.

11. An image forming apparatus comprising:

a target to be cooled detachably installable in the image forming apparatus; and a cooling device to cool the target using a liquid coolant, the cooling device including:

a heat receiving part separately contactable to the target, a heat releasing part to release heat from the liquid coolant, a circulation channel through which the liquid coolant is circulated between the heat receiving part and the heat releasing part, the circulation channel including a flexible part and a metal part continuous with the flexible part, a shielding member surrounding an entirety of a longitudinal extension of the flexible part of the circulation channel, and a pump operatively connected to the circulation channel to convey the liquid coolant through the circulation channel.

12. The cooling device according to claim 1, wherein the shielding member includes a plurality of shield parts that engage with each other to form a container around the flexible part so as to prevent scattering of coolant from a leak from the flexible part.

13. The cooling device according to claim 12, wherein the plurality of shield parts include two shield parts that are U-shaped and engage so as to form a tubular shape around the flexible part.

14. The cooling device according to claim 13, wherein the tubular shape has at least one end thereof open.

15. The cooling device according to claim 1, wherein the flexible part extends vertically within the shielding member.

16. The cooling device according to claim 3, wherein an entirety of the flexible part is disposed on a side of the partition member opposite the target to be cooled.

17. The cooling device according to claim 1, wherein the shielding member has at least one end thereof open.

18. The cooling device according to claim 2, wherein the shielding member has at least one end thereof open.

* * * * *